US007479610B2

(12) United States Patent
Meier et al.

(10) Patent No.: US 7,479,610 B2
(45) Date of Patent: Jan. 20, 2009

(54) INSULATING PART FOR A HIGH VOLTAGE SWITCH OF A METAL ENCLOSED CIRCUIT BREAKER SYSTEM

(75) Inventors: Guido Meier, Würenlingen (CH); Jean-Claude Mauroux, Hunzenschwil (CH); Leopold Ritzer, Untersiggenthal (CH)

(73) Assignee: Abb Research Ltd, Zurich (CH)

( * ) Notice: Subject to any disclaimer, the term of this patent is extended or adjusted under 35 U.S.C. 154(b) by 104 days.

(21) Appl. No.: 11/730,895

(22) Filed: Apr. 4, 2007

(65) Prior Publication Data

US 2008/0245644 A1 Oct. 9, 2008

(51) Int. Cl.
*H01H 1/64* (2006.01)

(52) U.S. Cl. ..... 200/293; 200/401

(58) Field of Classification Search ..... 200/244, 200/246, 293, 400, 401; 218/140, 172–176
See application file for complete search history.

(56) References Cited

OTHER PUBLICATIONS

"Generator Circuit-Breaker Systems HECs, HEC 7/8." Abb Switzerland Ltd product description, Publication IHC0023255 E01 /AC05.

*Primary Examiner*—Michael A Friedhofer
*Assistant Examiner*—Lisa N Klaus
(74) *Attorney, Agent, or Firm*—Buchanan Ingersoll & Rooney PC

(57) ABSTRACT

An insulating part (20) is provided for a high voltage switch of a metal-enclosed circuit-breaker system and is executed as a pressure-gelated casting on the base of a polymeric composite material. It comprises a base-plate (21) with a centrally arranged large through-hole (23) for receiving a current terminal lead of the high voltage switch and with small through-holes (24, 25) for receiving fastening screws. The insulating part further comprises two bearing blocks (22) for receiving a shaft of a movable contact of a contact arrangement of the switch and at least a first collar (26) which surrounds the large through-hole (23).

For reason of the execution as a pressure-gelated casting the insulating part (20) can be manufactured easily with low costs but with high precision. In general a finish-maching of the casting is not required. The integration of the large through-hole (23) and of the small through-holes (24, 25) as well as of the two bearing blocks (22) and the first collar (26) into the insulating part (20) during pressure gelation of the polymeric composite material result in a complex design which fulfills all required mechanical, electrical and thermal functions during operation of the system.

15 Claims, 3 Drawing Sheets

INSULATING PART FOR A HIGH VOLTAGE SWITCH OF A METAL ENCLOSED CIRCUIT BREAKER SYSTEM

TECHNICAL FIELD

The invention relates to the field of high voltage circuit breakers in electrical power generation and distribution systems. It is based on an insulating part for a high voltage switch of a metal-enclosed circuit breaker system, in particular a generator circuit breaker system with rated maximum voltages of typically 20 to 30 kV, rated continuous currents of typically 1 to 30 kA and rated short current circuits of up to up some hundred kA.

PRIOR ART

At present insulating material for a mechanically and electrically stressed insulating part of complex design which is applied in a high voltage switch of such a system is milled out of hard paper plates. These milled hard-paper plates can be stuck together in order to manufacture specific designs of complex structure and with different functions. Such an insulating part is applied in a starting switch of a generator circuit breaker system of the type HECS manufactured and sold by ABB Switzerland Ltd.

DESCRIPTION OF THE INVENTION

It is an object of the invention as described in the patent claims to specify an insulated part for a high voltage switch of a metal enclosed circuit breaker system which fully meets the mechanical, electrical and thermal requirements during operation of the system and which at the same time can be manufactured in an easy manner.

The insulating part according to the invention is executed as a pressure-gelated casting on the base of a polymeric composite material and comprises a comparatively complex design, which enables the performance of a plurality of functions. A base-plate of the insulating part has a centrally arranged large through-hole for receiving a stationary current terminal block of the high voltage switch and small through-holes for receiving fastening screws. The large through-hole and the small through-holes are extended from a first to a second side of the base-plate, wherein the first side is provided for exposure to the interior of the metal encapsulation. The insulating part further comprises two bearing blocks for receiving a shaft of a movable contact of a contact arrangement of the switch wherein the bearing blocks are arranged on the first side of the base-plate. Besides the insulating part includes at least a first collar which surrounds the large through-hole and which is arranged on the first or the second side of the base-plate.

For reason of the execution as a pressure-gelated casting the insulating part according to the invention can be manufactured easily with low costs but with high precision. In general a finish-maching of the casting is not required. The integration of the large through-hole and of the small through-holes as well as of the two bearing plates and the first collar into the insulating part during pressure gelation of the polymeric composite material result in a complex design which fulfills several functions. On the one hand the insulating part can support the movable contact and the stationary current terminal block and can be connected to the metal enclosure of the system. On the other hand the insulating part and thus the high voltage switch can be charged with strong mechanical forces and can withstand high voltages, in particular during opening or closing the switch.

In a preferred embodiment of the invention the first collar includes said two bearing blocks and two spacers which are arranged between the two bearing blocks. The first collar then stabilizes the insulating part mechanically and at the same time ensures a safe bearing of the movable contact and an improved resistance to tracking between the current terminal block and the metal enclosure even under extreme environmental conditions. The mechanical stability and the resistance to tracking can be remarkably improved, when the first collar and a second collar are oppositely arranged on the base-plate.

In a further embodiment the first collar and the two bearing blocks are oppositely arranged on the base-plate. Then the resistance to tracking outside the metal encapsulation is improved.

A high resistance to tracking, a high breakdown strength, a high thermal longterm stability and convenient mechanical properties, like flexural strength, can be achieved with a polymeric composite material which is based on an outdoor epoxy system filled with an anorganic powder, like quartz or alumina flour. For instance an increase in the creep distance from 9 to 16 mm/kV can easily be realised without additional costs. The manufactured insulating parts can be stored for an unlimited time at room temperature (UV resistance, negligible moisture absorption).

A further embodiment of the insulating part according to the invention which can be applied to a metal enclosure filled with an insulating gas, like air, with a small overpressure comprises a first annular groove for receiving a gasket in which the groove is arranged on the first side of the base-plate and is surrounded by a first group of the small through-holes. These through-holes can receive a first group of said fastening screws which enable a gastight fastening of the insulating part to the metal enclosure. A gastight passing of a current terminal of the high voltage switch through the metal enclosure is ensured when a second annular groove for receiving a gasket is arranged on the second side of the base-plate and surrounds a second group of said small through-holes. These through-holes can receive a second group of said fastening screws which enable a gastight fastening of a current terminal block of said current terminal to the base-plate.

An embodiment of the insulating part in which in the pressure-gelated casting is cast at least one insert can be manufactured in a particular cost- and time-saving manner. In particular the lateral insert can be positioned in a mould and then can be fixed during pressure gelation and hardening of the polymer system. Such an insert can be executed as a threaded sleeve. It is to recommend to arrange the threaded sleeve at the edge of the base-plate and to use it for receiving a further fastening screw which can fasten a metallic envelope surrounding a current conductor which connects an external current source to the high voltage switch.

In order to reduce installation costs it is to recommend in a further embodiment of the invention to execute the insert as a bearing bolt and to arrange it in a through-hole of one of the bearing blocks.

In order to improve the reliability and to reduce the manufacturing and maintenance costs it is to recommend to apply the insulating part according to the invention in a circuit breaker system in which the switch is executed as starting switch and in which the insulating part supports a current terminal block which on the first side of the base-plate is connected to a flexible current conductor section of the starting switch and on the second side of the base-plate to a current conductor of a static frequency converter.

Further embodiments, advantages and applications of the invention are given in the drawings and in a part of the description which follows.

BRIEF DESCRIPTION OF THE DRAWINGS

There are shown in.

WAYS TO IMPLEMENT THE INVENTION

In the figures same reference symbols are used for identical parts and repetitive reference symbols may be omitted.

Figure 1:
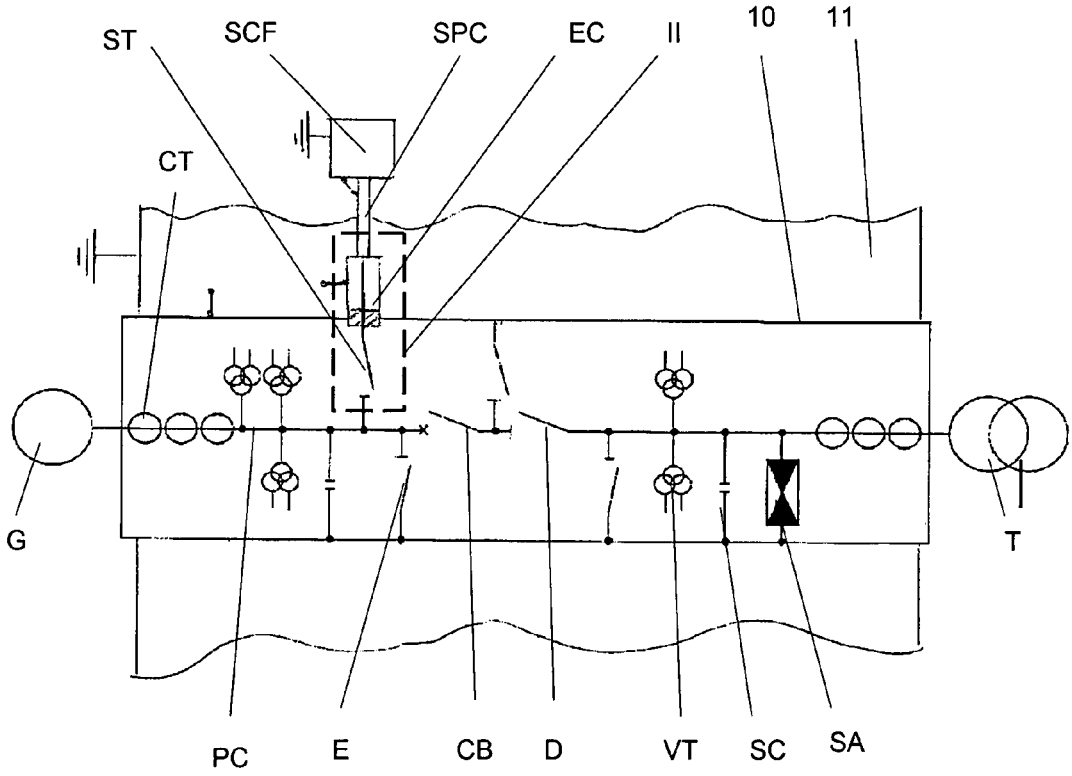
FIG. 1 a top view into one schematically plotted pole of a generator circuit breaker system comprising a starting switch with an insulating part according to the invention, FIG. 2 in perspective representation a bordered part II of the breaker system of FIG. 1 including the insulating part, FIG. 3 a view on a section through the part II of FIG. 2 along a plane III-III, FIG. 4 in perspective representation a top view of the insulating part of FIGS. 2 and 3, FIG. 5 in perspective representation a view of the insulating part of FIGS. 2 and 3 from below, and FIG. 6 in perspective representation a current terminal block supported on the insulating part of FIGS. 2 and 3.

The pole of the generator circuit breaker system of FIG. 1 connects a phase conductor PC of a generator G to a transformer T and comprises a metal enclosure 10 which is filled with air with small overpressure and which is arranged in an electrically conducting manner on a metal frame 11 that is connected to ground. In the metal enclosure are arranged a circuit breaker CB, a disconnector D, earthing switches E, a starting switch ST, a surge capacitor SC, current transformers CT, voltage transformers VT and a surge arrester SA. The starting switch ST connects a static frequency converter SCF to a section of the phase conductor PC which is arranged within the metal enclosure 10 and extends between generator G and circuit breaker CB. The converter SCF is arranged outside the metal enclosure 10 and is connected by means of a shielded power cable SPC and an encapsulated conductor section EC to a terminal of the starting switch ST which is conducted through the metal enclosure 10. The starting switch ST and its current connection are designed for the voltage, current and current-duration occurring during a starting up period of a gas turboset which comprises the generator G and a gas turbine (not shown).

Figure 2:
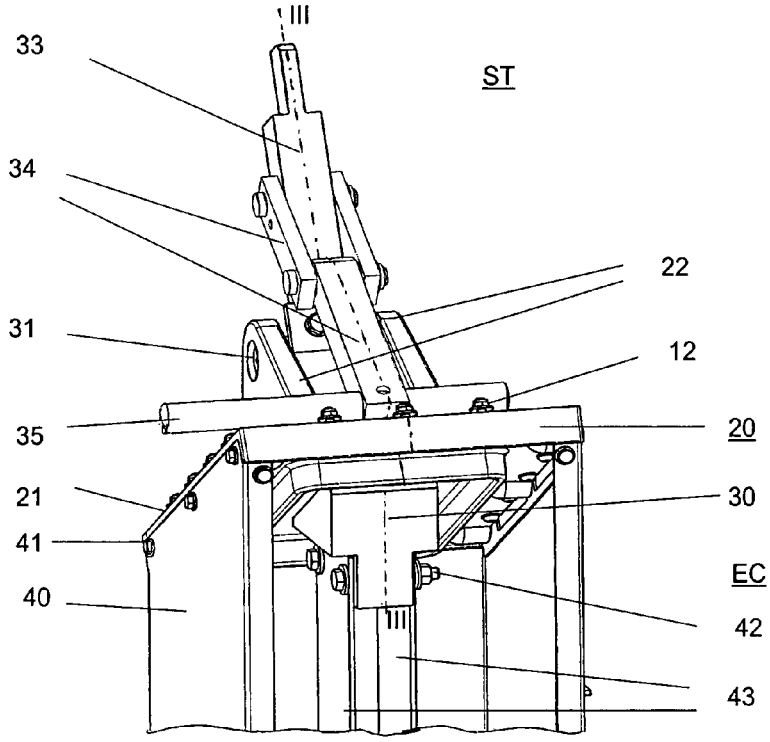
Figure 3:
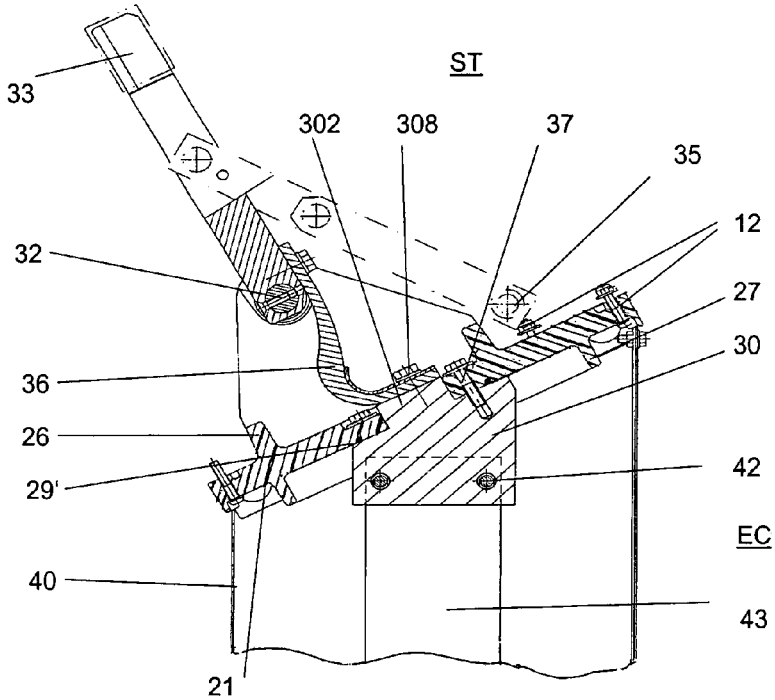

Details of the starting switch ST are shown in FIGS. 2 and 3. The starting switch ST comprises an insulating part 20 with a horizontally extended base-plate 21 which supports two vertically extended bearing blocks 22. Each block 22 carries a bearing bolt 31 for receiving a shaft 32 (only shown in FIG. 3) of a movable contact 33 of the starting switch ST. The movable contact 33 can be pivoted around the shaft axis and works together with a stationary contact of the starting switch ST which is positioned on said section of the phase conductor PC arranged within the enclosure 10. The movable contact 33 is connected by means of two rotary links 34 with a shaft 35 which is brought out of the metal enclosure 10 and transmits mechanical force from a drive via the rotary links 34 to the movable contact 33. A flexible conductor section 36 connects the movable contact 33 with a current terminal block 30 in an electrically conducting manner. The current terminal block 30 is fixedly secured to the insulating part 20 by means of screws 37, whereas the insulating part 20 is fixedly secured to the metal enclosure 10 (only shown in FIG. 1) by means of fastening screws 12. A metal enclosure 40 of the encapsulated conductor section EC is fixedly secured to the insulating part 20 by means of fastening screws 41. Two flat current conductor bars 43 of the encapsulated conductor section EC are fixedly secured to the current terminal block 30 by means of fastening screws 42.

Figure 4:
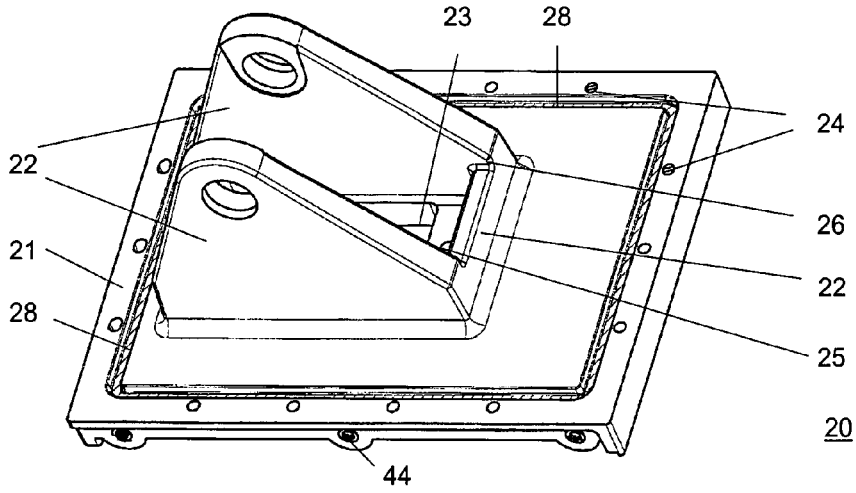
Figure 5:
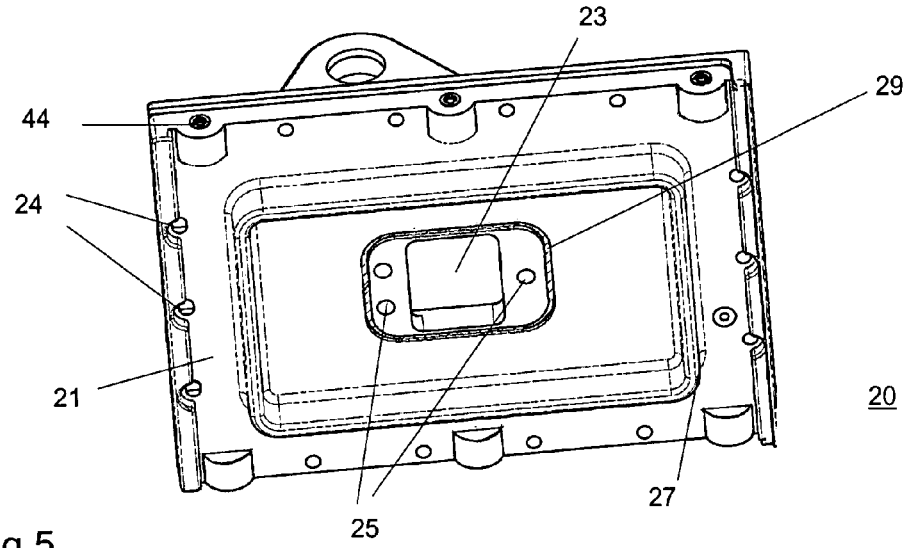

Details of the insulating part 20 are shown in FIGS. 4 and 5. The base-plate 21 comprises a centrally arranged large through-hole 23 for receiving the current terminal block 30, a first group of small through-holes 24 for receiving the fastening screws 41 and a second group of small through-holes 25 for receiving the fastening screws 37. The large through-hole 23 and the small through-holes 24, 25 are extended from a first to a second side of the base-plate 21, wherein the first side is provided for exposure to the interior of the metal encapsulation 10 and comprises the two bearing blocks 22. A collar 26 surrounds the large through-hole 23. The collar 26 is arranged on the first side of the base-plate 21 and includes the two bearing blocks 22 and two spacers 22' which are arranged between the two bearing blocks 22. Oppositely arranged on the second side of the base-plate 21 and also surrounding the large through-hole 23 is a collar 27 (shown in FIG. 5). The collars 26 and 27 improve the mechanical stability of the insulating part 20 and at the same time improve the tracking distance between a part, to which—like the current terminal block 30—is applied high voltage, and a part which—like the metal enclosure 10—is connected to ground.

In FIG. 4 is shown an annular groove 28 which surrounds the large through-hole 23 and which is arranged on the first side of the base-plate 21. The groove 28 is surrounded by the first group of small through-holes 24 and is provided for receiving a gasket. For reason of this gasket the screws 12 can fasten the base-plate 21 in a gastight manner to the metal enclosure 10.

In FIG. 5 is shown an annular groove 29 which surrounds the large through-hole 23 and the small through-holes 25. The groove 29 is provided for receiving a gasket 29' which is shown in FIG. 3. For reason of the gasket 29' (shown in FIG. 3) the screws 37 can fasten the current terminal block 30 in a gastight manner to the base-plate 21.

The insulating part 20 is manufactured in an automatic pressure gelation (APG) process using an outdoor epoxy system which is filled with quartz flour and which fully meets the required mechanical, electrical, thermal and surrounding boundary conditions. An appropriate epoxy system comprises for instance an epoxy resin of the type CY5622, a hardener of the type XW1235 and an accelerator of the type DY062, all distributed from Huntsman, Basel/Switzerland. The quartz flour in general is silanised and contributes with more than fifty, typically 60 until 65, % of weight to a paste-like starting mixture including mainly the epoxy system and the quartz flour. Typically the insulating part 20 has a mass of about 10 to 20 kg.

In the pressure-gelated casting at least one insert can be cast. Such an insert can be executed as a threaded sleeve 44 and can be arranged at the edge of the base-plate 21 (FIGS. 4 and 5). The sleeve 44 works together with the screws 41 for fastening the metal enclosure 40. An insert can also be executed as the bearing bolt 31 and can be arranged in a through-hole of one of the bearing blocks 22.

Figure 6:
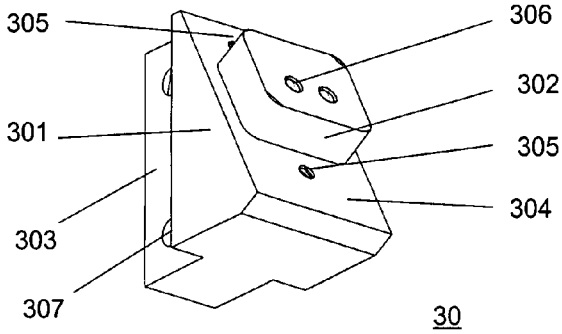

FIG. 6 shows an embodiment of the current terminal block 30 in which the current terminal block comprises a base section 301 and two connection fittings 302 and 303 arranged on opposite faces of the base section. The base section 301 on the first face comprises a sealing surface 304 and three holes 305. These holes are designed in a manner to receive the screws 37. The connection fitting 302 comprises two holes 306 for receiving two screws 308 (shown in FIG. 3) which are provided for fastening the flexible current conductor section 36 to the fitting 302, whereas the connection fitting 303 comprises two holes 307 for receiving the screws 42.

| List of Reference Signs | |
|---|---|
| G | generator |
| T | transformer |
| PC | phase conductor |
| SFC | static frequency converter |
| EC | encapsulated conductor section |
| SPC | shielded power cable |
| CB | circuit breaker |
| D | disconnector |
| E | earthing switches |
| ST | starter switch |
| SC | surge capacitor |
| CT | current transformers |
| VT | voltage transformers |
| SA | surge arrester |
| 10 | metal enclosure |
| 11 | metal frame |
| 12 | fastening screws |
| 20 | insulating part |
| 21 | base-plate |
| 22 | bearing blocks |
| 22' | spacers |
| 23 | large through-hole |
| 24, 25 | small through-holes |
| 26, 27 | collars |
| 28, 29 | annular grooves |
| 30 | current terminal block |
| 31 | bearing bolt |
| 32 | shaft |
| 33 | movable contact |
| 34 | rotary links |
| 35 | shaft |
| 36 | flexible current conductor section |
| 37 | fastening screws |
| 40 | metal enclosure |
| 41, 42 | fastening screws |
| 43 | flat current conductor bars |
| 44 | threaded sleeve |
| 301 | base section |
| 302, 303 | connection fittings |
| 304 | sealing surface |
| 305, 306, 307 | holes |
| 308 | fastening screws |

The invention claimed is:

1. An insulating part for a high voltage switch of a metal-enclosed circuit-breaker system which is executed as a pressure-gelated casting on the base of a polymeric composite material and which comprises a base-plate with a centrally arranged large through-hole for receiving a current terminal lead of the high voltage switch and with small through-holes for receiving fastening screws, in which the large through-hole and the small through-holes are extended from a first to a second side of the base-plate, wherein the first side is provided for exposure to the interior of the metal encapsulation, two bearing blocks for receiving a shaft of a movable contact of a contact arrangement of the switch, which bearing blocks are arranged on the first side of the base-plate, and at least a first collar which surrounds the large through-hole and which is arranged on the first or the second side of the base-plate.

2. The insulating part of claim 1 in which the first collar includes said two bearing blocks and two spacers which are arranged between the two bearing blocks.

3. The insulating part of claim 2 in which the first collar and a second collar are oppositely arranged on the base-plate.

4. The insulating part of claim 1 in which the first collar and the two bearing blocks are oppositely arranged on the base-plate.

5. The insulating part of claim 1 in which the polymeric composite material is based on an outdoor epoxy system filled with an anorganic powder.

6. The insulating part of claim 1 in which a first annular groove for receiving a gasket is arranged on the first side of the base-plate and is surrounded by a first group of the small through-holes which are provided for receiving a first group of the screws for fastening the base-plate gastightly to the metal enclosure.

7. The insulating part of claim 6 in which a second annular groove for receiving a gasket is arranged on the second side of the base-plate and surrounds a second group of the small through-holes which are provided for receiving a second group of the screws for fastening a current terminal block of said current terminal lead gastightly to the base-plate.

8. The insulating part of claim 1 in which in the pressure-gelated casting is cast at least one insert.

9. The insulating part of claim 8 in which said insert is executed as a threaded sleeve.

10. The insulating part of claim 9 in which the threaded sleeve is arranged at the edge of the base-plate and is provided for receiving screws for fastening a metallic enclosure surrounding a current conductor which connects an external current source to said switch.

11. The insulating part of claim 8 in which said insert is executed as a bearing bolt and is arranged in a through-hole of one of the bearing blocks.

12. A circuit breaker system comprising the insulating part according to claim 1 in which the switch is executed as a starting switch of a generator circuit breaker system and in which the insulating part supports a current terminal block, which on the first side of the base-plate is connected to a flexible current conductor section of the starting switch and on the second side of the base-plate to a current conductor which is electrically connected to a static frequency converter.

13. The circuit breaker arrangement of claim 12 in which the current terminal block comprises a base section and two connection fittings which are arranged on opposite faces of said base section, wherein the base section on the first face comprises a sealing surface and at least a first hole for receiving a first screw, that fastens the base section to the insulating part,, wherein a first of the two connection fittings comprises at least a second hole for receiving a second screw for fastening the flexible current conductor section to the current terminal block and wherein a second of the two connection fittings comprises at least a third hole for receiving a third screw for fastening the current conductor of the static frequency converter to the current terminal block.

14. A circuit breaker system comprising the insulating part according to claim 11 in which the switch is executed as a starting switch of a generator circuit breaker system and in which the insulating part supports a current terminal block, which on the first side of the base-plate is connected to a flexible current conductor section of the starting switch and on the second side of the base-plate to a current conductor which is electrically connected to a static frequency converter.

15. An insulating part for a high voltage switch, comprising:

a base-plate with a centrally arranged large through-hole for receiving a current terminal lead of the high voltage switch and with small through-holes for receiving fastening screws, in which the large through-hole and the small through-holes are extended from a first to a second side of the base-plate, wherein the first side is exposed;

two bearing blocks for receiving a shaft of a movable contact of a contact arrangement of the switch, which bearing blocks are arranged on the first side of the base-plate; and at least a first collar which surrounds the large through-hole and which is arranged on the first or the second side of the base-plate.

* * * * *